United States Patent [19]

Josefowicz

[11] Patent Number: 4,595,466

[45] Date of Patent: Jun. 17, 1986

[54] METAL ELECTROLYSIS USING A LOW TEMPERATURE BATH

[75] Inventor: Jack Y. Josefowicz, Westlake Village, Calif.

[73] Assignee: Atlantic Richfield Company, Los Angeles, Calif.

[21] Appl. No.: 709,466

[22] Filed: Mar. 7, 1985

[51] Int. Cl.[4] ..... C25C 3/04; C25C 3/06

[52] U.S. Cl. ..... 204/67; 204/70

[58] Field of Search ..... 204/67, 70

[56] References Cited

U.S. PATENT DOCUMENTS 4,342,637 8/1982 Withers et al. ..... 204/294

FOREIGN PATENT DOCUMENTS 2805374 8/1979 Fed. Rep. of Germany ..... 204/67

*Primary Examiner*—Howard S. Williams

*Attorney, Agent, or Firm*—Donald L. Traut

[57] ABSTRACT

A cell for the electrolytic deposition of metal at low temperatures and low electrical consumption in which an anode of a metal oxide and reducing agent immersed in an electrolytic molten halide salt bath comprises lithium chloride and sodium fluoride, the bath formulated to have high electrical conductivity and very low solubility for the metal oxide, as well as the recovered metal. The electrolytic molten halide salt bath is substantially absent of the metal to be recovered.

11 Claims, No Drawings

METAL ELECTROLYSIS USING A LOW TEMPERATURE BATH

FIELD OF THE INVENTION

This invention relates to the electrolytic production of a metal from the metal oxide using a bath containing halides and having very low solubility for the metal. A composite anode is used in conjunction with the bath to supply the metal oxide and a reducing agent to the bath.

BACKGROUND OF THE INVENTION

The commercial production of certain metals, particularly aluminum and magnesium, has been typically accomplished by the Hall-Heroult Process. In this well known process, a purified source of the metal is dissolved in a molten salt bath particularly consisting of cryolite. All chloride salts, fluoride salts or heavy salts such as barium are then electrolytically recovered at a cathode. A characteristic advantage of this type of process is low cell power efficiency due to the low electrical conductivity of the electrolytic bath, since at least a portion of the electrical energy applied to the cell is converted by resistance to heat. The advantage of the Hall-Heroult Process (that is, cell power efficiency) has reached a practical limit in energy-saving efficiency despite careful design and operation of 150 to 200K. amp. cells at anode current densities ranging between 4.5 and 5.5 amp. per square inch. The lowest energy consumption limit appears to be about 5.6 to 6.0 kilowatt hours per pound of aluminum recovered utilizing the most advanced designs, computer controls, staff modifications, and other improvements.

One approach to solving this particular problem is illustrated by U.S. Pat. No. 4,338,177 issued to Withers et al. for an electrolytic cell for the production of aluminum. In this patent, there is disclosed an electrolytic cell comprising an anode of aluminum oxide and a reducing agent, a cathode, and a molten electrolyte which does not dissolve the aluminum oxide compound in substantial quantities when the temperature of the electrolyte is in the range of 650° to 900° C. The cell includes a porous membrane which separates the anode and the cathode, and comprises a material having a connected pore size sufficiently small to screen out the mixture of aluminum oxide and reducing agent, but sufficiently large to pass the aluminum ions therethrough. The energy consumption for such a cell ranges from about 3.67 to 4.25 kwh/lb. of aluminum recovered. The anode and cathode spacing of Withers et al. ranges from about 0.25 to about 1.0 inch, although the smaller spacing has been shown by Withers et al. to result in less efficiency due to the liberation of carbon dioxide from the anode reaction and subsequent back reaction with the aluminum in the cathode layer. Withers et al. redesigned the cell to eliminate this problem and efficiencies were measured at about 92 percent. The electrolytic fluoride or chloride bath in Withers et al. typically contained a halide of aluminum, either chloride or fluoride, in percentages which ranged from about 1 to 95 percent. In the chloride cycle, Withers et al. required some portion of the aluminum oxide in the bath, presumably to avoid the anode effect.

In a treatise entitled "Principles of Magnesium Technology," the miminum energy required for recovery of aluminum and magnesium was disclosed as 3.5 and 3.0 kwh/lb. of metal recovered, respectively. Magnesia was noted as being insoluble in chloride salt baths. Lithium chloride was shown to have high conductivity when compared to typical bath materials, but due to its high cost was not recommended for use unless there was a sufficient improvement in cell design to justify such cost. The treatise also disclosed a Dow Lithium Chloride process in which the electrolyte comprised between 5 and 38 weight percent magnesium chloride; the balance, apart from the small addition of alkali or alkaline earth fluorides, being lithium chloride. In this recovery process for magnesium, the magnesium chloride content was held above 5 to prevent liberation of lithium with the recovered magnesium. The magnesium chloride content was limited to 38 percent to maintain a desirable density difference between the metals and the malts. Energy efficiencies ranged from 4.5 to 5.0 kwh/lb. of magnesium recovered and a narrow electrode gap of 1 was utilized.

SUMMARY OF THE INVENTION

It has been discovered that an electrolytic cell for the production of a metal with reduced electrical energy consumption may be accomplished including:

(1) an electrolyte disposed in a cell;

(2) a cathode immersed in the electrolyte for electrolytic winning of the metal; and (3) an anode immersed in the electrolyte comprising an oxygen-containing compound of the metal and a reducing agent;

the electrolyte comprising a material in which the metal is substantially insoluble at normal electrolytic conditions and which comprises a salt which is substantially absent the metal.

DETAILED DESCRIPTION OF THE INVENTION

The following process description will reference aluminum, but it is understood that the process is applicable to the recovery of any metal oxide, including but not limited to aluminum, magnesium, titanium, etc.

The electrolytic process of the present invention for the production of an aluminum metal at a cathode uses substantially less energy to produce high quality aluminum with the total absence of chlorine gas exiting from the cell. Production of the aluminum metal at the cathode is brought about through the formation of an anode from aluminum oxide and a reducing agent. The anode and the cathode are immersed in an electrolytic molten bath containing alkali metal or alkaline earth metal halide salt of selected compositions which is substantially insoluble to the metal itself. More particularly, the electrolyte bath comprises halide salts having a substantial absence of aluminum—the metal to be recovered.

In the present invention, the bath composition may include any halide salt, but chloride and flouride are particularly favored. Any alkali metal or alkaline earth metal such as sodium, potassium, lithium, calcium, magnesium, and barium may be used to form the halide salt, as long as the metal is not the metal being recovered.

The desired composition of the electrolytic bath provides that the metal is substantially insoluble in the bath at normal electrolytic conditions. For purposes of definition herein, the "substantially insoluble" is defined to be a concentration of the metal of less than 0.5 weight percent of the electrolytic bath. The electrolytic bath should also comprise a halide salt(s) which is substantially absent of the metal to be recovered. The term "substantially absent" is defined to be a concentration of the metal which is below about 1 weight percent of the bath. The electrolytic bath should also have an electrical conductivity of at least 3.5 $ohm^{-1}$ $centimeter^{-1}$. Preferably, the electrolytic bath comprises chloride salts substantially absent of the chloride of the metal to be recovered. More preferably, the electrolytic bath for use in recovery of aluminum and magnesium comprises lithium chloride and sodium fluoride. More preferably, the bath comprises 85 to 90 weight percent lithium chloride and 10 to 15 weight percent sodium fluoride. Still more preferably, the bath comprises about 86 weight percent lithium chloride and about 14 weight percent sodium fluoride.

The anode provides the source of metal ions for the reduction to the metal at the cathode, as well as a means to conduct electrical current through the metal oxide to the reaction site for the metal oxide. In one embodiment, the anode may also provide at least a part of a necessary source of a reducing agent. The reducing agent is preferably at least in part intermixed with the metal oxide, but also may be in gaseous form in this embodiment to provide intimate contact with the metal oxide. The reducing agent should be selected to be conductive when intermixed with the metal oxide.

The metal produced at the cathode generally is as pure as the metal material forming the anode. Bath temperatures generally range from about 700° to about 800° C., and preferably from about 700° to about 750° C.

EXAMPLE 1

The electrolyte salt composition consisted of 90 percent lithium chloride and 10 percent sodium fluoride. The composite anode comprising 85 weight percent aluminum and 15 weight percent carbon was calcined at 1000° C. The anode was then immersed in the electrolyte salt composition. The bath was operated at 750° C. at a current density ranging up to 1.0 amp. per centimeter squared at a spacing of about 1 centimeter. At a current density of 0.75 amp./in.$^2$, a potential of 2.9 volts resulted. No chlorine gas was observed at a discharge exit port nor was an anode effect experienced during operation of the bath. The composition of the metal deposited in the molten pool was about 99.9 percent pure aluminum. The recovered metal was produced at a Faraday efficiency of 62 percent with an energy consumption of 7.52 kwh/lb.

EXAMPLE 2

The electrolyte salt composition consisted of 90 percent lithium chloride and 10 percent sodium fluoride. The composite anode comprising 87 weight percent magnesium oxide and 13 weight percent carbon was calcined at 1000° C. The anode was then immersed in the electrolyte salt composition. The bath was operated at 750° C. at a current density ranging up to 1.0 amp. per centimeter squared at a spacing of about 1 centimeter. At a current density of 0.75 amp./cm.$^2$, a potential of 3.6 volts resulted. No chlorine gas was observed at a discharge exit port nor was an anode effect experienced during operation of the bath. The composition of the metal deposited in the molten pool was about 99.9 percent pure magnesium. The recovered metal was produced at a Faraday efficiency of 87 percent with an energy consumption of 4.13 kwh/lb.

EXAMPLE 3

The electrolyte salt composition consisted of 90 percent lithium chloride and 10 percent sodium fluoride. The composite anode comprising 88 percent magnesium oxide and 13 percent carbon was calcined at 1000° C. The anode was then immersed in the electrolyte salt composition. The bath was operated at 750° C. at a current density ranging up to 1.0 amp. per centimeter squared at a spacing of about 1 centimeter. At a current density of 0.75 amp./cm.$^2$, a potential of 3.5 volts resulted. No chlorine gas was observed at a discharge exit port nor was an anode effect experienced during operation of the bath. The composition of the metal deposited in the molten pool was about 99.9 percent pure magnesium. The recovered metal was produced at a Faraday efficiency of 80 percent with an energy consumption of 4.37 kwh/lb.

While the present invention has been described in terms of preferred embodiments, it is to be understood that the present invention is not limited thereto and that it can be variously practiced within the scope of the following claims.

Having thus described the invention and certain embodiments thereof, the invention which is claimed is:

1. A method of producing a metal selected from a group consisting of aluminum and magnesium comprising the steps of:

Providing an electrolyte cell including an electrolyte comprising from 85 to 90 percent by weight lithium chloride and 10 to 15 percent by weight sodium fluoride; and having a substantial absence of a salt of said metal;

a cathode immersed in said electrolyte for electrolytic winning of said metal; and an anode comprising a mixture of an oxygen-containing compound of said metal and a reducing agent; and operating said cell to produce said metal deposited in a molten pool in said cell.

2. The method of claim 1 wherein the concentration of said metal in said electrolyte is less than about 0.5 weight percent of said electrolyte.

3. The method of claim 2 wherein the concentration of said metal is less than about 0.1 weight percent of said electrolyte.

4. The method of claim 1 wherein said electrolyte comprises chloride salts of metals other than said metal.

5. The method of claim 1 wherein said electrolyte comprises alkali metal and alkaline earth metal salts.

6. The method of claim 1 wherein said electrolyte comprises about 86 weight percent lithium chloride and about 14 weight percent sodium fluoride.

7. The method of claim 1 wherein said anode comprises about 80 to 90 weight percent metal oxide of said metal and about 10 to 20 weight percent reducing agent.

8. The method of claim 7 wherein said metal oxide comprises about 85 weight percent of said anode and said reducing agent comprises about 15 weight percent of said anode.

9. The method of claim 8 wherein said reducing agent is carbon.

10. The method of claim 9 wherein said carbon is a conductive carbon.

11. The method of claim 1 wherein the conductivity of said electrolyte is greater than about 3.5 ohms/centimeter$^2$.

* * * * *